US005909908A

United States Patent [19]

Furuse

[11] Patent Number: 5,909,908

[45] Date of Patent: Jun. 8, 1999

[54] COMBINED PROCESSING APPARATUS

[75] Inventor: Yoshinobu Furuse, Wako, Japan

[73] Assignee: Honda Giken Kogyo Kabushiki Kaisha, Tokyo, Japan

[21] Appl. No.: 08/931,441

[22] Filed: Sep. 16, 1997

[30] Foreign Application Priority Data

Oct. 16, 1996 [JP] Japan ..... 8-273764

[51] Int. Cl.[6] ..... B23P 23/04

[52] U.S. Cl. ..... 29/33 T; 72/464; 72/466.2

[58] Field of Search ..... 29/34 R, 33 D, 29/33 T; 72/466.2, 464, 370.27

[56] References Cited

U.S. PATENT DOCUMENTS 1,812,046 6/1931 Groehn ..... 72/426 X 3,456,482 7/1969 Maier et al. ..... 72/466.2

3,533,266 10/1970 Anderson ..... 72/466.2 X

FOREIGN PATENT DOCUMENTS 0 088 152 A1 9/1983 European Pat. Off. .

2 078 142 1/1982 United Kingdom .

*Primary Examiner*—William Briggs

*Attorney, Agent, or Firm*—Armstrong, Westerman, Hattori, McLeland & Naughton

[57] ABSTRACT

A combined processing apparatus includes a punching mechanism having a punch or a drill for punching in a hollow material, and a bending mechanism for bending the hollow material. A core bar is inserted into the hollow material. The core bar is provided with a recess portion in correspondence to a position of the punch or the drill, which serves as a die upon punching a hole in the hollow material.

6 Claims, 5 Drawing Sheets

COMBINED PROCESSING APPARATUS

BACKGROUND OF THE INVENTION

1. Field of the Invention

The present invention generally relates to a combined processing apparatus, which can perform a punching process while bending a hollow material as a workpiece.

2. Description of the Related Art

FIGS. 5A to 5C are views which explain a bending process and a punching process of an extruded material in accordance with a conventional method, which generally comprises the following steps for bending and punching a workpiece. FIGS. 5A and 5B show principles of a conventional typical bender.

In FIG. 5A, a bender 100 is provided with a metal mold 101, a fixed chuck 102 and a movable chuck 103. A hollow material as a workpiece 104 is clamped by the fixed chuck 102 and the movable chuck 103. The movable chuck 103 applies a tension to the hollow material 104 in a direction of arrow (1).

FIG. 5B shows a bending process which is performed by moving the movable chuck 103 in a direction toward the metal mold 101 as shown in arrow (2), while applying a tension to the hollow material 104 by means of the movable chuck 103,; thereby, pressing the hollow material 104 to a curved surface 105 of the metal mold 101.

FIG. 5C shows a punching process, which is performed by punching holes 108 and 109 in the bent hollow material 104 by means of drills 106 and 107 of a drilling machine.

However, in the above conventional embodiment, it is necessary to take off the workpiece from the bending machine and set the workpiece to the drilling machine. Accordingly, since the above conventional embodiment requires two steps for processing, there is a problem that the time necessary for processing gets extended thereby, increasing the cost for processing.

FIGS. 6A, 6B, 6C and 6D show several kinds of cross sections of a conventional workpiece. When various kinds of small parts are attached to the workpiece or the workpiece is attached to the other member by a bolt or the like, it is necessary to punch the workpiece so as to insert the bolt or the like or to attach a clip thereto. Concrete examples thereof will be explained below.

FIG. 6A shows an example in which a workpiece 111 having a channel shape is mounted on a die 112 and a hole 114 is punched by a punch 113. Reference numeral 115 denotes a punching scrap.

FIG. 6B shows an example in which a hole 124 is punched in a workpiece 121 having a rectangular cross section by a punch 123. Reference numeral 125 denotes a punched scrap. In a case in which the workpiece 121 is a light alloy extruded material (such as, an aluminum alloy or the like), since a rigidity is small, a punched surface is curved downward as shown and it is necessary to correct this curved deformation so that a number of the processing step is increased and a cost for processing is increased. Accordingly, it is necessary to form the workpiece 111 into a channel shape as shown in FIG. 6A, thereby directly receiving the surface to be punched by the die 112. Otherwise, as shown in FIG. 5C mentioned above, it is necessary to punch by the drills 106 and 107. Because the drills 106 and 107 give less effect to the hollow material 104 as a workpiece than the punch 123.

FIGS. 6C and 6D show examples in which a clip 133 having an inverted-T cross section is attached to a workpiece 133 with a recessed groove 131. If an extrude molding is employed, the recessed groove 131 can be integrally formed with ease so that it is not necessary to punch the workpiece 132.

However, as is apparent from FIGS. 6A and 6B, if the workpiece has a rectangular cross section, there is no way to form a hole without punching by the drills so that the hole is limited to a circular hole.

Further, the examples of FIGS. 6C and 6D have a problem that the weight is increased at a degree of the recessed groove 131 so that the cost for material is increased and the total weight of the structure is increased.

SUMMARY OF THE INVENTION

In accordance with the present invention, there is provided a combined processing apparatus for bending a hollow material as a workpiece and punching in the hollow material, which comprises: a core bar having at least one recessed portion formed on one surface thereof and being designed for insertion into the hollow material; a punching mechanism having a punching device in correspondence to the recessed portion and being designed for punching a hole in the hollow material by entering a front end portion of the punching device into the recessed portion; at least one tilting core bar mounted to a front end of the core bar in such a manner as to freely tilt; and a bending mechanism for bending the hollow material about the tilting core bar, thereby continuously performing a punching process and a bending process to the hollow material.

In one preferred embodiment, a punch or a drill may be used as the punching device. The punch or drill punches a hole in the hollow material by using the core bar as a die. Next, the bending mechanism performs a bending process to the hollow material. Accordingly, the punching process and the bending process of the hollow material can be performed by only one step so that a reduction of the processing time and a miniaturization of the associated equipment can be achieved.

The head tilting core bar among the tilting core bar is pivotally connected to the core bar in such a manner as to rotate in vertical and horizontal directions relative to the core bar, thereby coping with various kinds of bending of the hollow material.

A rod is mounted to a rear end portion of the core bar for restricting the motion of the core bar at a predetermined position. Due to the restriction of the core bar by this rod, a hole is punched in a predetermined position of the hollow material.

The bending mechanism has a bending piece for bending the hollow material. The bending piece has a through hole for allowing passage of the hollow material therethrough. The bending piece is constructed such that it can be adjusted in posture three-dimensionally so as to perform various kinds of bending to the hollow material.

The combined processing apparatus in accordance with the present invention further includes a workpiece guide member for guiding the hollow material so as to prevent transverse movement of the hollow material upon bending of the hollow material by the bending mechanism.

BRIEF DESCRIPTION OF THE DRAWINGS

A preferred embodiment of the present invention will be explained in detail below with reference to the accompanying drawings, in which.

DETAILED DESCRIPTION OF THE PREFERRED EMBODIMENT

The following description is merely exemplary in nature and is in no way intended to limit the invention or its application or uses.

Figure 1:
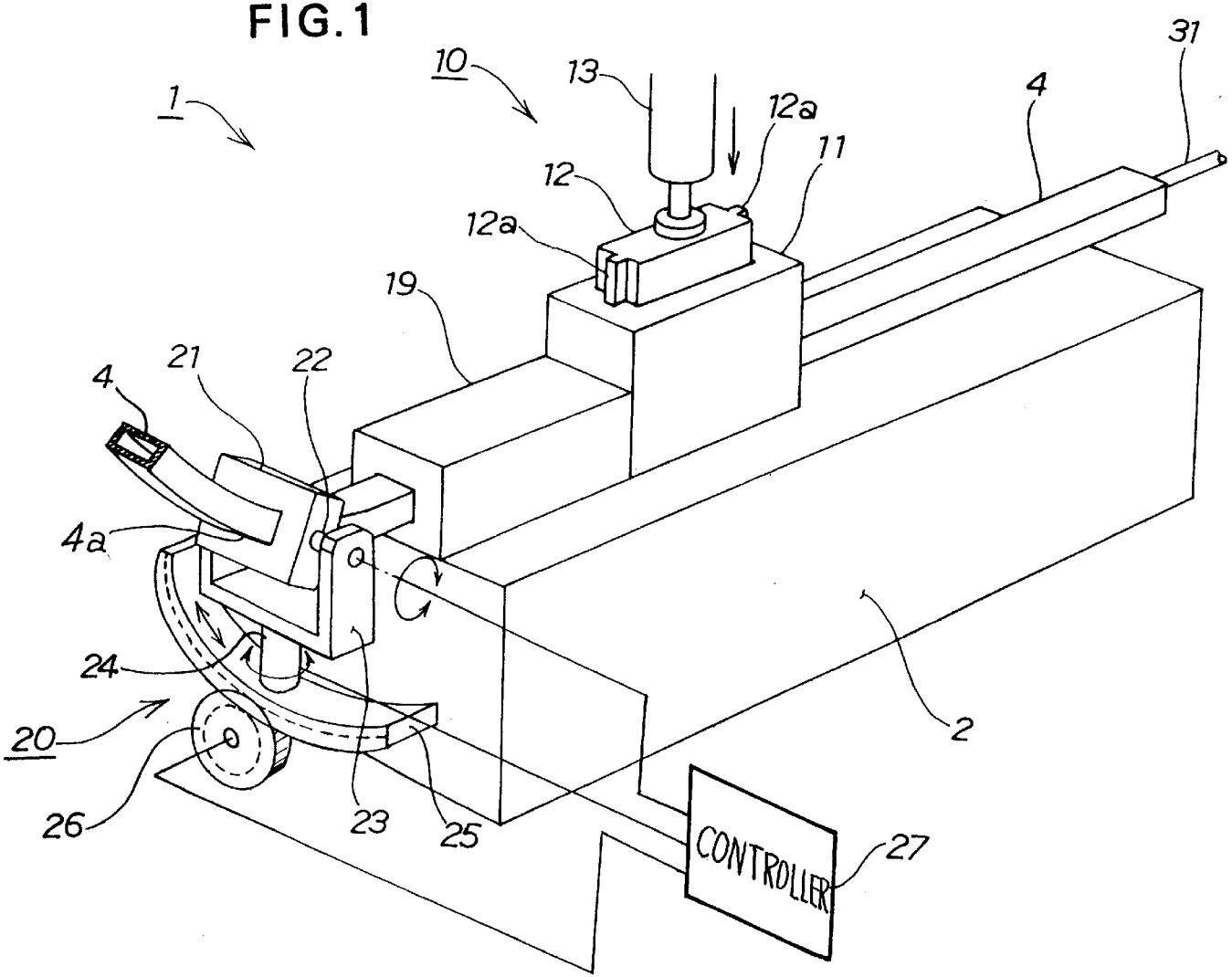
FIG. 1 is a perspective view which shows a combined processing apparatus in accordance with the present invention.

In FIG. 1, a combined processing apparatus 1 has a punching mechanism for punching in a hollow material 4 as a workpiece and disposed on a bed 2. A workpiece guide member 19 for preventing a side run-out with a bore or the like of the hollow material 4 at a time of continuously bending the hollow material 4 is provided in a downstream of the punching mechanism 10. A bending mechanism 20 for bending the hollow material 4 to various directions is provided in an outlet side of the bed. A core bar 30 (referring to FIG. 2) is inserted into the hollow material 4. The core bar 30 serves as a die for punching in the hollow material 4.

A bending device (so-called multi-bender) is used as the bending mechanism 20. The bending mechanism 20 has a bending piece 21, including a through hole 4*a*, for passing the hollow material 4 so as to perform a bending process of the hollow material 4. The bending piece 21 is held by a holding member 23 through a horizontal axis 22 in such a manner that the bending piece 21 can rotate in a vertical direction. The holding member 23 has a perpendicular axis 24 for rotating the holding member 23 in a horizontal direction. Further, the holding member 23 is mounted to a swing wheel 25 through the perpendicular axis 24. The swing wheel 25 has gear teeth and is swung in a direction of an arrow by rotation of a gear 26 which is engaged with the gear teeth. The gear 26 moves a total structure consisting of the swing wheel 25, the holding member 23 and the bending piece 21. The perpendicular axis 24 moves the holding member 23 and the bending piece 21. The horizontal axis 22 moves only the bending piece 21. Accordingly, the bending piece 21 is adjusted in a three-dimensional direction. That is, by adjusting in three dimensions the posture of the bending piece 21, the hollow material 4 can be bent in only a vertical direction, or in a horizontal and vertical directions, or a twisting direction or in the other directions. The posture or attitude of the bending piece 21 for performing the above various kinds of bending process can be controlled by a controller 27.

Figure 2:
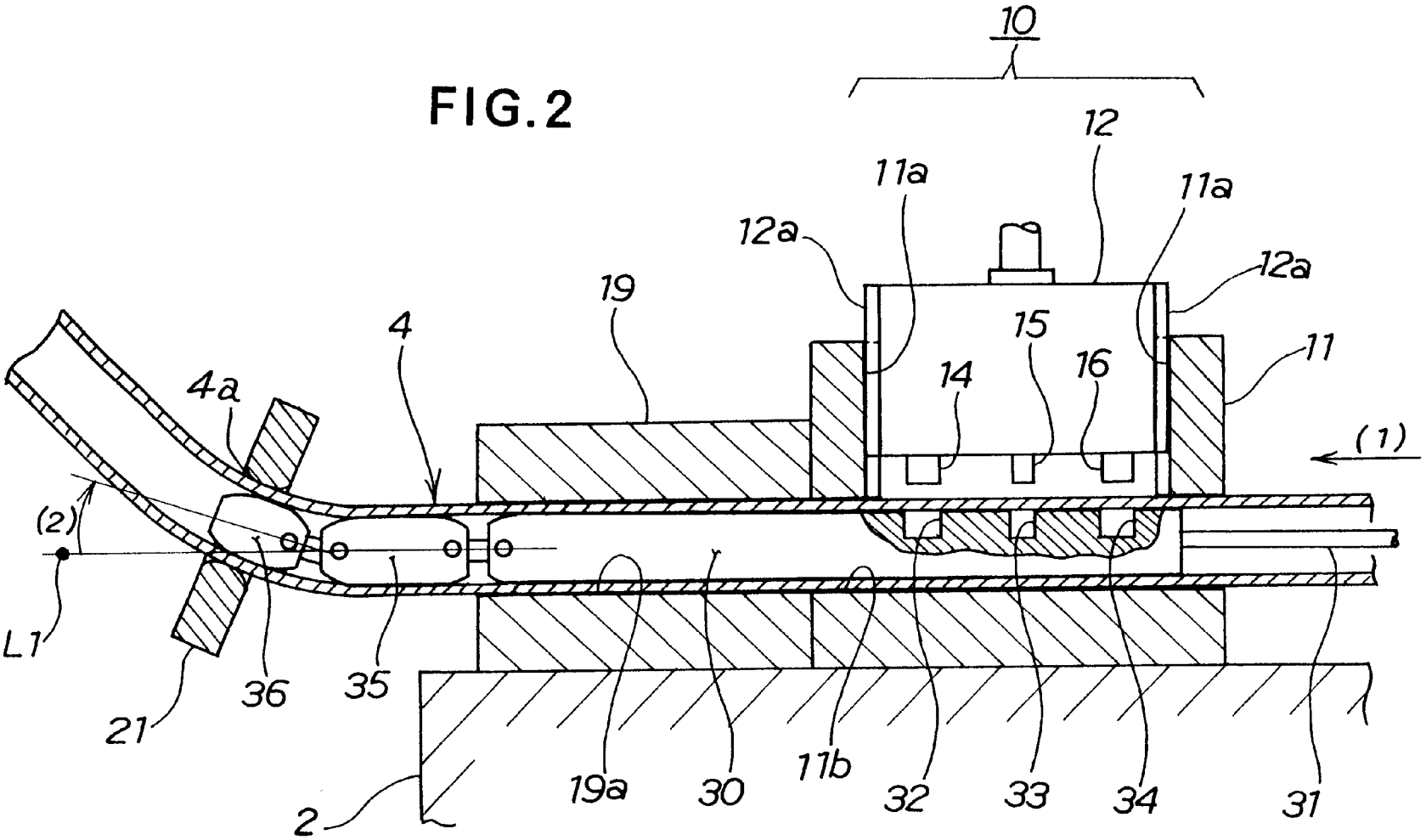
FIG. 2 is a cross sectional view of a combined processing apparatus.

In FIG. 2, the punching mechanism 10 has a stand block 11 mounted on the bed 2. A holder 12 is mounted in the stand block 11 in such a manner as to move in a vertical direction. The holder 12 is ascended and descended by an oil hydraulic cylinder 13 (referring to FIG. 1). A plurality of punches 14, 15 and 16 are provided on a lower surface of the holder 12. A pair of guide grooves 11*a* and 11*a* extending in a vertical direction are formed on the stand block 11. A pair of convex surfaces 12*a* and 12*a* extending in a vertical direction so as to correspond to the guide grooves 11*a* and 11*a* are formed on the holder 12. The convex surfaces 12*a* and 12*a* are fitted into the guide grooves 11*a* and 11*a* and the holder 12 is vertically moved along the guide grooves 11*a* and 11*a*. A through hole 11*b* for passing the hollow material 4 therethrough is formed in the stand block 11.

The workpiece guide member 19, the detailed inner structure of which is omitted, serves to guide the hollow material 4 in such a manner as to prevent a side run-out with the bore of the hollow material 4 at a time of bending the hollow material 4 by means of the bending mechanism 20. A guide hole 19*a* communicated with the through hole 11*b* is formed in the workpiece guide member 19.

The core bar 30 is a member, which is inserted into the hollow material 4, has a rod 31 in a rear end thereof and is provided with recessed portions 32, 33 and 34, which correspond to a shape of the punches 14, 15 and 16 of the holder 12 on an upper surface thereof. Two tilting core bars 35 and 36 are connected to a front end portion of the core bar 30 in such a manner as to freely tilt. The tilting core bars 35 and 36 prevent the hollow material 4 from being bent with a flat state at a time of bending the hollow material 4 by means of the bending piece 21 and bend the hollow material 4 in a state of a round circle. Further, in the present invention, the tilting core bar 35 for connection disposed in a middle may be omitted and the tilting core bar 36 disposed in a head may be directly mounted to the core bar 30. Still further, the head tilting core bar 36 is pivotally connected in such a manner as to freely tilt not only in a vertical direction but also in a lateral direction (an inside and outside direction in the drawing).

Next, an operation of the combined processing apparatus having the above-described structural arrangements will be explained below.

In FIG. 2, the straight hollow material 4 is pressed into the through hole 11*b* of the stand block 11 and the guide hole 19*a* of the workpiece guide member 19 in a direction shown in the arrow (1) so as to enter the front end portion of the hollow material 4 into the bending piece 21. At this time, a center of the bending piece 21 is on a line L1. The core bar 30 is inserted into the hollow material 4 in accordance with the arrow (1) until the tilting core bar 36 reaches the bending piece 21. In this case, the hollow material 4 to which the tilting core bars 35 and 36 and the core bar 30 are previously inserted may be pressed into the stand block 11 and the workpiece guide member 19. In the present invention, operating orders are not limited to this embodiment.

Next, the hollow material 4 is bent by rotating the bending piece 21 upward as shown in the arrow (2). Then, thereafter the extruding mechanism (not shown) extrudes only the hollow material 4 at a low speed as shown in the arrow (1). Accordingly, the hollow material 4 can be continuously bent. In this case, the core bar 30 is stopped so as not to be moved in a moving direction of the hollow material 4. In other words, when each of the recessed portions 32, 33 and 34 reaches a position corresponding to each of the positions of the punches 14, 15 and 16, a motion of the core bar 30 is restricted by the rod 31.

Figure 3:
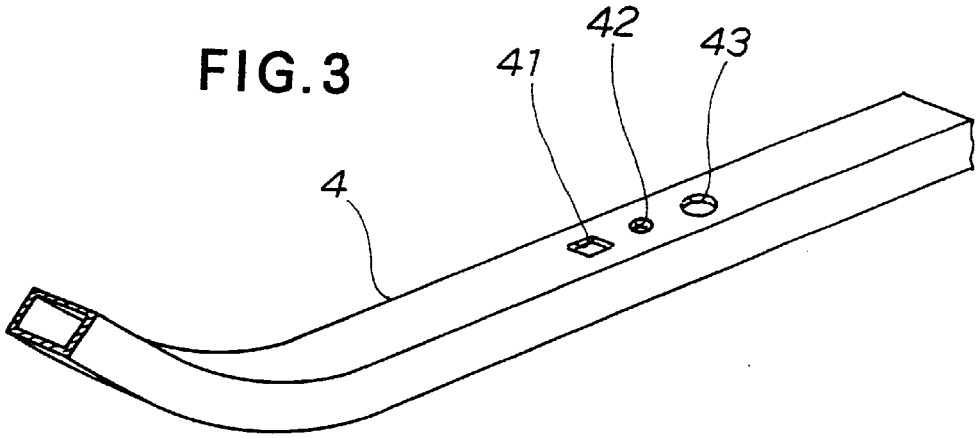
FIG. 3 is a perspective view which shows an example of a hollow material manufactured by a combined processing apparatus in accordance with the present invention.

Next, when a predetermined portion of the hollow material 4 reaches the stand block 11, the holder 12 is immediately descended and the punches 14, 15 and 16 are entered into the recessed portions 32, 33 and 34 so as to punch in the hollow material 4. FIG. 3 shows an example of the hollow material which is manufactured by the combined processing apparatus in accordance with the present invention. For example, the hollow material 4 is a curbed beam, a linear portion of which is provided with a rectangular hole 41, a circular hole 42 and an oval hole 43 in a middle portion thereof. Accordingly, the combined processing apparatus in accordance with the present invention is characterized in that an opening having an optional shape and an optional size can be formed by modifying a shape of the punches 14, 15 and 16 and the recessed portions 32, 33 and 34 shown in FIG. 2, and that a deflection or the like is not generated in the hollow material 4 by serving the core bar 30 as the die, as shown in FIG. 2.

Figure 4:
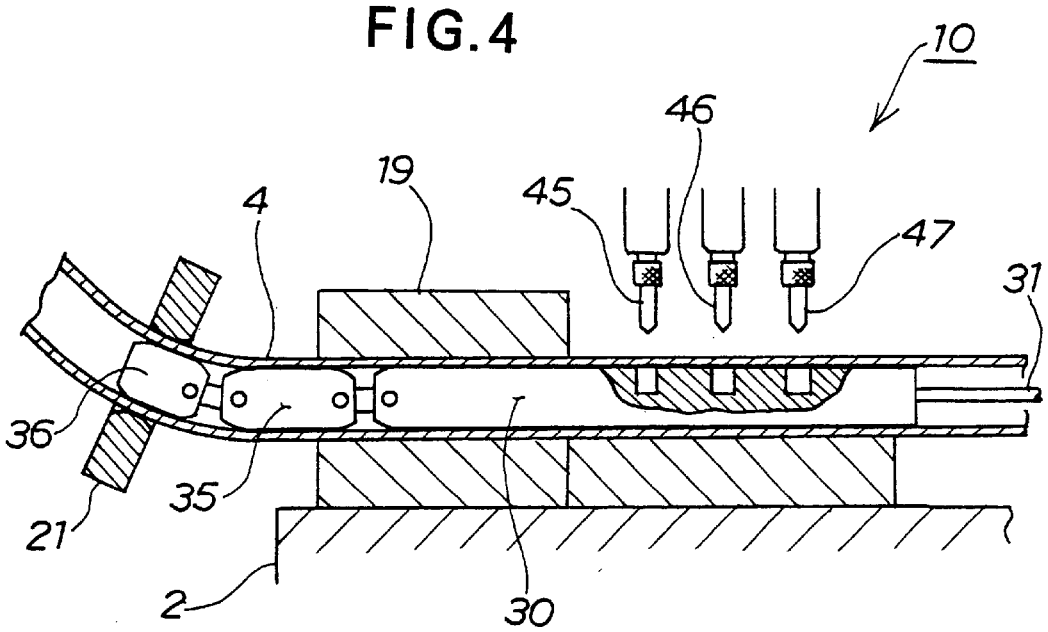
FIG. 4 is a cross sectional view which shows a modified embodiment of a combined processing apparatus.
Figure 5A:
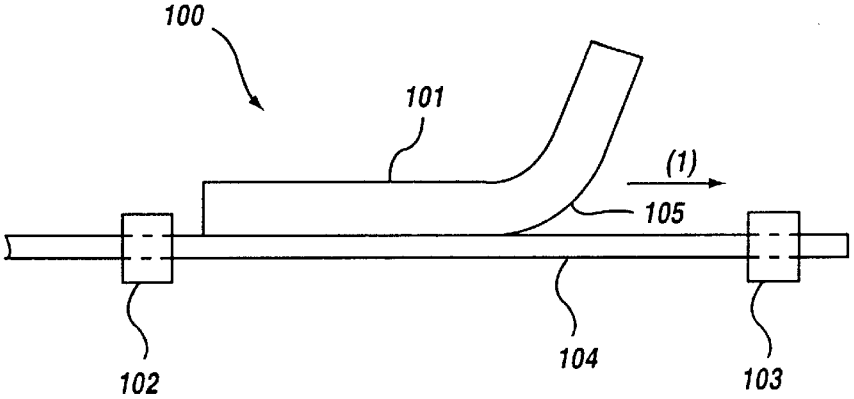
FIG.5A PRIOR ART
FIGS. 5A to 5C are views which explain a bending process and a punching process of an extruded material in accordance with a conventional method.
Figure 5B:
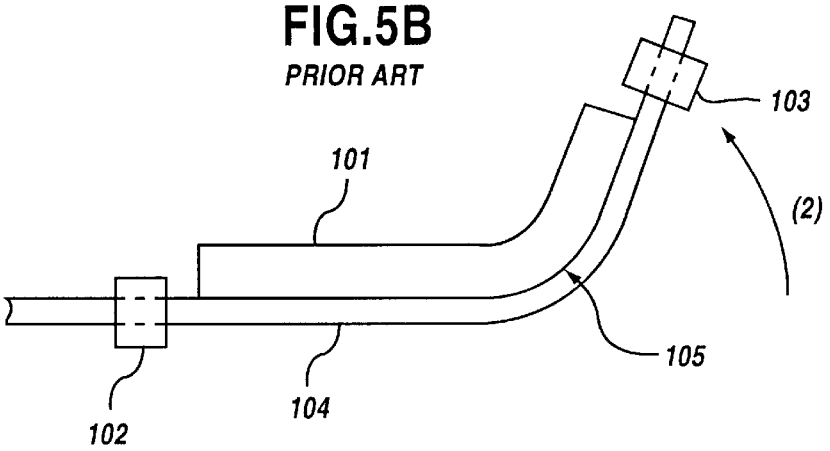
FIG.5B PRIOR ART
Figure 5C:
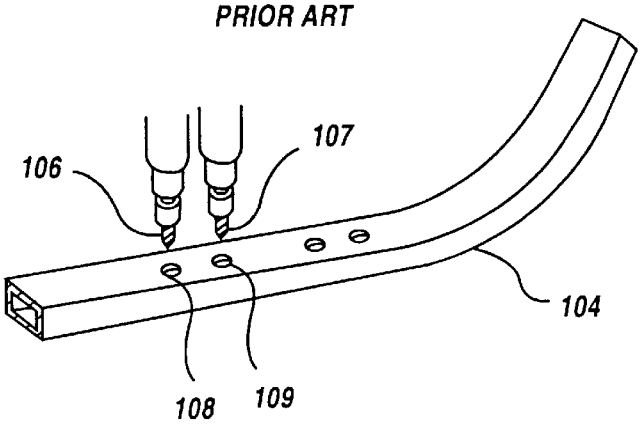
FIG.5C PRIOR ART
Figure 6A:
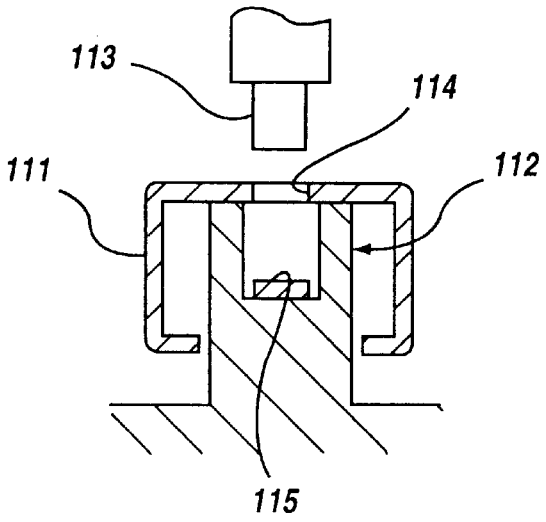
FIG.6A PRIOR ART
FIGS. 6A to 6D show several kinds of cross sections of a conventional workpiece.
Figure 6B:
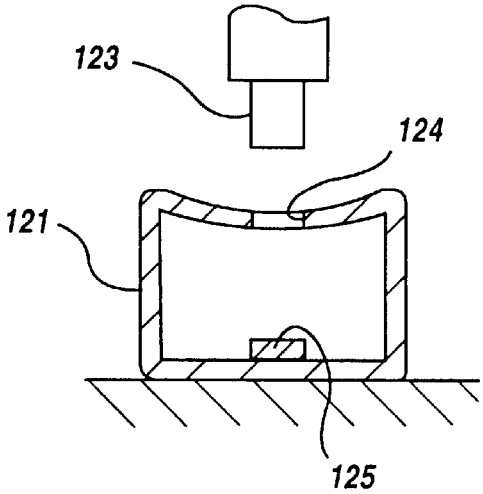
FIG.6B PRIOR ART
Figure 6C:
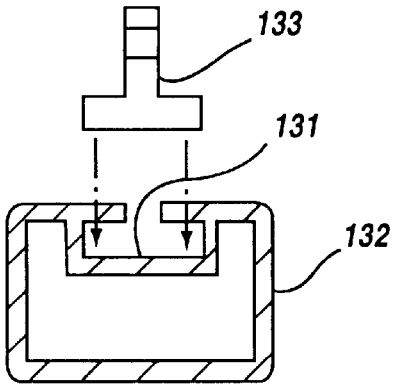
FIG.6C PRIOR ART
Figure 6D:
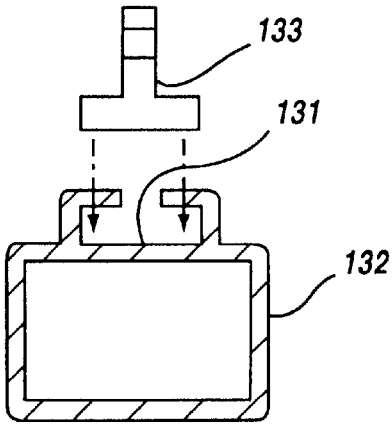
FIG.6D PRIOR ART

FIG. 4 is a cross section which shows a modified embodiment of the combined processing apparatus in accordance with the present invention, in which drills 45, 46 and 47 are employed in the punching mechanism 10. The other structures however, are similar to that of FIG. 2, the same reference numerals are attached to the same elements and the detailed explanation thereof is omitted. Accordingly, a hole is punched in a predetermined position of the hollow material 4 by each of the drills 45, 46 and 47.

In FIGS. 2 to 4, an embodiment in which the hole is punched on the upper surface of the hollow material 4 is shown. However, the hole can be punched on a side surface or a lower surface of the hollow material 4.

Further, a number of the punches 14, 15 and 16 and a number of the drills 45, 46 and 47 are optionally selected.

As mentioned above, in accordance with the combined processing apparatus of the present invention, a bending process and a punching process can be performed at a single step and a shape of a hole can be optionally selected.

While the invention has been particularly shown and described in reference to preferred embodiments thereof, it will be understood by those skilled in the art that changes in form and details may be made therein without departing from the spirit and scope of the invention.

What is claimed is:

1. A combined processing apparatus for bending a hollow material as a workpiece and punching the hollow material, said combined processing apparatus comprising:

a core bar having at least one recessed portion formed on one surface thereof, said core bar capable of being inserted into said hollow material;

a punching mechanism, having a punching device in correspondence to said recessed portion, for punching a hole in said hollow material by entering a front end portion of said punching device into said recessed portion;

at least one tilting core bar mounted to a front end of said core bar, said at least one tilting core bar capable of freely tilting; and a bending mechanism for bending the hollow material about said tilting core bar to thereby continuously perform a punching process and a bending process to said hollow material.

2. A combined processing apparatus as recited in claim 1, wherein said tilting core bar includes a head tilting core bar pivotally connected to said core bar in such a manner as to rotate in vertical and horizontal directions relative to said core bar.

3. A combined processing apparatus as recited in claim 1, wherein said core bar has a rod mounted to a rear end portion thereof for restricting the motion of said core bar at a predetermined position.

4. A combined processing apparatus as recited in claim 1, wherein said bending mechanism includes a bending piece for bending said hollow material.

5. A combined processing apparatus as recited in claim 3, wherein said bending piece is supported by said bending mechanism for adjustment in posture three-dimensionally.

6. A combined processing apparatus as recited in claim 1, further comprising a workpiece guide member for guiding said hollow material so as to prevent transverse movement of said hollow material upon bending of the hollow material via the bending mechanism.

* * * * *